US008617321B2

(12) United States Patent
Misawa et al.

(10) Patent No.: US 8,617,321 B2
(45) Date of Patent: Dec. 31, 2013

(54) SURFACE TREATMENT METHOD FOR ALUMINUM ALLOY AND SURFACE TREATMENT METHOD FOR MAGNESIUM ALLOY

(75) Inventors: Shunji Misawa, Tsuchiura (JP); Sakae Inayoshi, Tokyo (JP); Hiroshi Sato, Chigasaki (JP)

(73) Assignees: Ulvac, Inc., Chigasaki-Shi (JP); Ulvac Techno, Ltd., Chigasaki-Shi (KP)

( * ) Notice: Subject to any disclaimer, the term of this patent is extended or adjusted under 35 U.S.C. 154(b) by 787 days.

(21) Appl. No.: 12/443,904

(22) PCT Filed: Oct. 2, 2007

(86) PCT No.: PCT/JP2007/069285

§ 371 (c)(1), (2), (4) Date: Apr. 1, 2009

(87) PCT Pub. No.: WO2008/041701

PCT Pub. Date: Apr. 10, 2008

(65) Prior Publication Data

US 2010/0096044 A1 Apr. 22, 2010

(30) Foreign Application Priority Data

Oct. 2, 2006 (JP) ..... P2006-271115

(51) Int. Cl.

| | |
|---|---|
| ***C23C 22/57*** | (2006.01) |
| ***C23C 22/56*** | (2006.01) |
| *C23C 22/05* | (2006.01) |

(52) U.S. Cl.

USPC ..... 148/275; 148/243

(58) Field of Classification Search

USPC ..... 148/275, 243

See application file for complete search history.

(56) References Cited

U.S. PATENT DOCUMENTS

| | | | | |
|---|---|---|---|---|
| 6,461,451 | B1 * | 10/2002 | Harenski et al. | 148/275 |
| 6,881,491 | B2 * | 4/2005 | Jankosky et al. | 428/472.2 |

FOREIGN PATENT DOCUMENTS

| | | |
|---|---|---|
| JP | 07180067 | 7/1995 |
| JP | 9176772 | 7/1997 |
| JP | 2001040464 | 2/2001 |
| JP | 2005-146329 | 6/2005 |
| JP | 2006089821 | 4/2006 |

OTHER PUBLICATIONS

International Search Report & Written Opinion from corresponding application PCT/JP07/069285.

Notice of Allowance from corresponding Japanese Application No. 2008-537534 with a mailing date of Jun. 21, 2011. English translation attached.

* cited by examiner

*Primary Examiner* — Lois Zheng

(74) *Attorney, Agent, or Firm* — Grossman, Tucker, Perreault & Pfleger, PLLC

(57) ABSTRACT

The present invention provides a surface treatment method for an aluminum alloy and a surface treatment method for a magnesium alloy, which enable providing the surface of an aluminum alloy containing magnesium or the surface of a magnesium alloy with sufficient corrosion resistance to corrosive gases, while preventing the surface from scattering magnesium therefrom even when used in a vacuum at a temperature of not less than 300° C. In this method, a carbon fluoride compound is applied over the surface of the aluminum alloy containing magnesium or the surface of the magnesium alloy, followed by heating in an oxygen atmosphere, thereby forming a fluoride passivation film.

10 Claims, 3 Drawing Sheets

SURFACE TREATMENT METHOD FOR ALUMINUM ALLOY AND SURFACE TREATMENT METHOD FOR MAGNESIUM ALLOY

TECHNICAL FIELD

The present invention relates to a surface treatment method for an aluminum alloy and a surface treatment method for a magnesium alloy which make it possible to obtain an aluminum alloy or a magnesium alloy which shows corrosion resistance even when it is used in a corrosive atmosphere and at which magnesium is not scattered from the surface thereof even when it is used at a temperature of not less than 300° C., by forming a fluoride passivation film including fluoride of magnesium on the surface of the aluminum alloy containing magnesium or the surface of the magnesium alloy.

The present application claims priority from Japanese Patent Application No. 2006-271115 filed on Oct. 2, 2006, and the content of which is hereby incorporated into this application.

BACKGROUND ART

In the past, for various apparatuses used in the process of manufacturing a liquid crystal display or the process of manufacturing a semiconductor, an aluminum alloy containing magnesium has been often used.

A surface of the various apparatuses is exposed to a strong corrosive gas such as a chlorine gas, a hydrogen fluoride gas, a fluorine radical, or the like. For the aluminum alloy used for the apparatuses, an alumite film has been formed on a surface thereof by an alumite treatment to improve a corrosion resistance and to archive a long-life thereof.

However, there was a problem that the alumite film is etched by the fluorine radical and then destroyed when the film is used for a long time.

A magnesium alloy oxidizes in the air on its own, a color of the surface thereof easily changes, and the magnesium alloy is also easily affected by salt damage.

In addition, for a surface treatment method for the aluminum alloy containing magnesium, there has been disclosed a method which includes the steps of heating an object in a container, introducing a dangerous fluorine-based gas or a fluorine-based compound gas into the container thereby heating the container, and forming a film made of a fluoride on the surface of the aluminum alloy containing magnesium (for example, refer to Japanese Unexamined Patent Application Publication No. 9-176772)

DISCLOSURE OF INVENTION

However, there has been a problem that the above-mentioned method cannot be applied to a process of manufacturing a liquid crystal display or a process of manufacturing a semiconductor because a film formed on a surface of an aluminum alloy or a magnesium alloy by using the above-mentioned method does not have enough corrosion resistance to corrosive gases and magnesium contained in the alloy is scattered when the alloy is heated in a vacuum at a temperature of up to 550° C.

The present invention is to solve the above-mentioned problem and an object of the invention is to provide a surface treatment method for an aluminum alloy and a surface treatment method for a magnesium alloy, which enables providing the surface of an aluminum alloy containing magnesium or the surface of a magnesium alloy with sufficient corrosion resistance to corrosive gases, while preventing the surface from scattering magnesium therefrom even when the aluminum alloy containing magnesium or the magnesium alloy is used in a vacuum at a temperature of not less than 300° C.

The present inventors have found that, by forming a fluoride passivation film on a surface of an aluminum alloy containing magnesium or a magnesium alloy, the aluminum alloy containing magnesium or the magnesium alloy does not corrode even when it is used in a corrosive atmosphere and it is possible to prevent scattering magnesium even when the aluminum alloy containing magnesium or the magnesium alloy is used in a vacuum at a temperature of not less than 300° C. Consequently, they have completed the present invention.

That is, a surface treatment method for the aluminum alloy of the invention includes forming the fluoride passivation film on the surface of the aluminum alloy containing magnesium in the oxygen atmosphere.

It is preferable to form the fluoride passivation film by applying a solution, in which a carbon fluoride compound is dispersed, on the surface of the aluminum alloy containing magnesium and then heating the alloy in the oxygen atmosphere.

It is preferable that the fluoride passivation film is composed of a metal compound containing magnesium and fluorine.

In addition, a surface treatment method for the magnesium alloy of the invention is for forming the fluoride passivation film on the surface of the magnesium alloy in the oxygen atmosphere.

It is preferable to form the fluoride passivation film by applying a solution, in which a carbon fluoride compound is dispersed, on the surface of the magnesium alloy and then heating the alloy in the oxygen atmosphere.

It is preferable that the fluoride passivation film is composed of a metal compound containing magnesium and fluorine.

According to the surface treatment method for an aluminum alloy of the present invention, since a fluoride passivation film is formed on the surface of an aluminum alloy containing magnesium in the oxygen atmosphere, it is possible to form the fluoride passivation film on the surface of the aluminum alloy containing magnesium without using a fluorine-based gas which has been used for a general method for forming a fluoride film.

In addition, according to the surface treatment method for the aluminum alloy of the invention, since a solution, in which a carbon fluoride compound is dispersed, is applied over the surface of the aluminum alloy containing magnesium and then the alloy is heated in the oxygen atmosphere, magnesium contained in the alloy is selectively reacted with fluorine and is reacted in the oxygen atmosphere to oxidize and separate carbon in the carbon fluoride compound, therefore no carbon remains in the fluoride passivation film. Accordingly, the obtained fluoride passivation film includes a metal compound containing magnesium and fluorine, thereby forming a film having a corrosion resistance and effective for preventing scattering of magnesium.

According to a surface treatment method for a magnesium alloy of the present invention, since a fluoride passivation film is formed on the surface of a magnesium alloy in the oxygen atmosphere, it is possible to form the fluoride passivation film on the surface of the magnesium alloy without using a fluorine-based gas which has been used in a general method for forming a fluoride film.

In addition, according to the surface treatment method for the magnesium alloy of the invention, since a solution, in which a carbon fluoride compound is dispersed, is applied over the surface of the magnesium alloy and then the alloy is heated in the oxygen atmosphere, magnesium contained in the alloy is selectively reacted with fluorine and is reacted in the oxygen atmosphere to oxidize and separate carbon in the carbon fluoride compound, therefore no carbon remains in the fluoride passivation film.

Accordingly, the obtained fluoride passivation film includes a metal compound containing magnesium and fluorine, thereby forming a film having a corrosion resistance and effective for preventing scattering of magnesium.

BEST MODE FOR CARRYING OUT THE INVENTION

Figure 1:
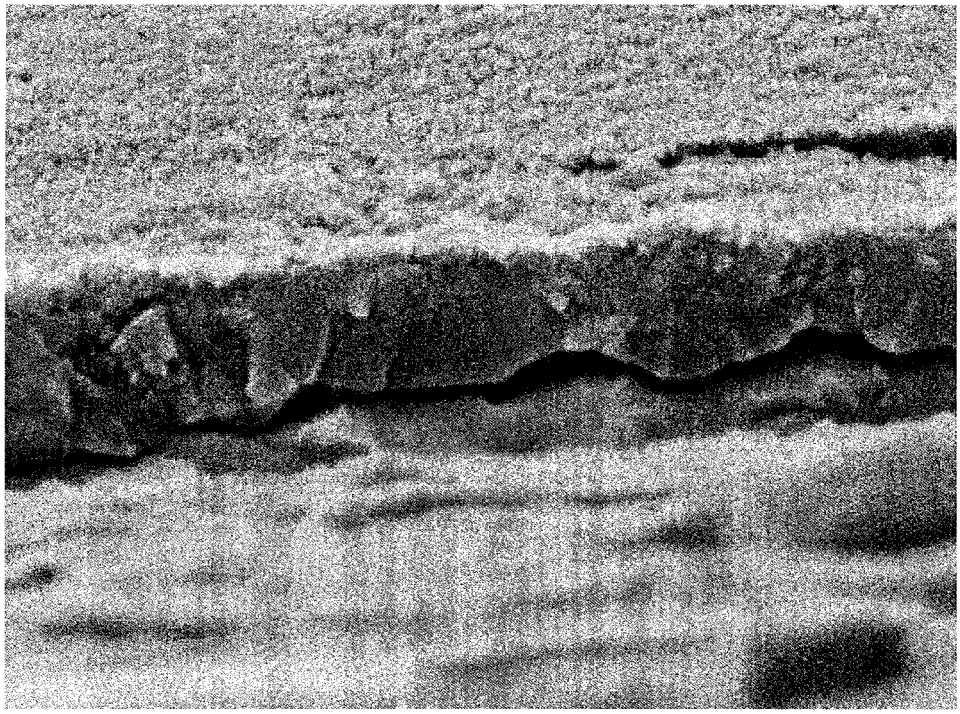
FIG. 1 is a scanning electron microscope image of a cross-section in the vicinity of the surface of an alloy containing magnesium prepared by Example 1, on which a fluoride passivation film is provided, taken by a scanning electron microscope.

The best mode for a surface treatment method for an aluminum alloy and a surface treatment method for a magnesium alloy according to the present invention will be described.

In addition, the embodiment will be described to easily understand the purpose of the invention and the invention is not limited thereto unless there is a specific designation.

For a process of forming an a-Si film based on a plasma CVD method, it is necessary to remove silicon (Si) precipitated around a heater of a plasma CVD apparatus at each certain process when each process is repeated for a certain number of times. Therefore, a silicon film precipitated around the heater has been etched and removed by a fluorine radical excited by a radio-frequency (RF) wave or a microwave by using gaseous nitrogen trifluoride ($NF_3$).

For the plasma CVD apparatus, peripheral equipments such as the heater and the like are constituted of materials made of the aluminum alloy and the like. The materials made of the aluminum alloy are generally covered with an alumite film by performing an alumite treatment on the surface thereof to improve corrosion resistance with respect to the fluorine radical and to prevent scattering of magnesium contained in the aluminum alloy when the alloy is used at the temperature of not less than 300° C. However, with regard to this alumite film, a part of the heater has been eliminated by repeating the above-mentioned treatment of removing silicon film when the plasma CVD apparatus is used for a long time. It was confirmed that, on the surface of the aluminum alloy of which alumite film is removed, magnesium contained in the alloy was dispersed on the surface of the alloy and the magnesium was reacted with the fluorine radical used for an etching to form a fluoride of magnesium, thereby forming a surface layer (film) stable to corrosive gases.

For the process of forming the a-Si film based on the plasma CVD method, a treatment temperature is in the range of from 350° C. to 450° C. in general. However, as the treatment temperature is higher, corrosion resistance is more required on a surface of a material made of the aluminum alloy.

In addition, when the alumite film or the like is not formed on the surface of the aluminum alloy containing magnesium or the magnesium alloy, magnesium is scattered in a vacuum at a temperature of not less than 300° C. and then is precipitated on the surface thereof even at a comparatively low temperature.

As mentioned above, the fluoride of magnesium combined with magnesium contained in the alloy and the fluorine radical has excellent corrosion resistance to the corrosive gases and a possibility to be an effective barrier film preventing scattering of magnesium.

For the aluminum alloy containing magnesium, when the fluoride film of magnesium is formed on the surface thereof in advance and the fluoride film is used as the passivation film, the film can be a more stable film than the alumite film.

For the method for forming the fluoride film of magnesium, a method of using fluorine-based gases can be exemplified as described in the Patent Document 1. However, the fluorine-based gases used in the method are extremely dangerous and an exclusive heatable container having a corrosion resistance is required to perform treatment with the fluorine-based gases.

In order to solve the above-mentioned problems, the surface treatment method for the aluminum alloy and the surface treatment method for the magnesium alloy of the invention use methods described below.

"A surface treatment method for an aluminum alloy"

A surface treatment method for an aluminum alloy of the invention is the method for forming a fluoride passivation film on a surface of the aluminum alloy containing magnesium in the oxygen atmosphere.

The surface treatment method for an aluminum alloy of the invention includes the steps of preparing a solution in which a carbon fluoride compound is dispersed (a process of preparing a solution), applying the solution in which a carbon fluoride compound is dispersed on the surface of the aluminum alloy containing magnesium (a process of applying the solution), heating the aluminum alloy containing magnesium in the oxygen atmosphere (a process of heating the alloy), and forming a fluoride passivation film on the surface of the aluminum alloy containing magnesium.

For the surface treatment method for the aluminum alloy of the invention, examples of the aluminum alloy containing magnesium, which is a target to be subjected to a surface treatment, include A5052 alloy, A6061 alloy, and the like.

In the process of preparing the solution in which a carbon fluoride compound is dispersed, the carbon fluoride compound is added to various solvents and the solvents are stirred to prepare the solution in which the carbon fluoride compound is uniformly dispersed.

For the carbon fluoride compound, polytetrafluoroethylene (PTFE), tetrafluoroethylene-perfluoroalkoxy ethylene copolymer (PFA), tetrafluoroethylene-hexafluoropropylene copolymer (FEP), ethylene-tetrafluoroethylene copolymer (ETFE), polychlorotrifluoroethylene (PCTFE), ethylene-chlorotrifluoroethylene copolymer (ECTFE), polyvinylidene fluoride (PVDF), polyvinyl fluoride (PVF), and the like are used.

For the solvents dispersing the carbon fluoride compound, alkyl ether, ethyl acetate, butyl acetate, and the like are used.

For the solution in which the carbon fluoride compound is dispersed, it is preferable that a content rate of the carbon fluoride compound is equal to or more than 30% by weight and equal to or less than 50% by weight, and equal to or more than 30% by weight and equal to or less than 40% by weight is more preferable.

The reason that the content rate of the carbon fluoride compound is equal to or more than 30% by weight and equal to or less than 50% by weight is because a fully uniform application quantity cannot be obtained when the content rate of the carbon fluoride compound is less than 30% by weight and a liquid pool readily forms when the content rate of the carbon fluoride compound is more than 50% by weight.

In addition, in the invention, it is possible to use the solution in which the carbon fluoride compound is dispersed as diluted by water.

In the process of applying the solution in which a carbon fluoride compound is dispersed, as for the method for applying the solution in which a carbon fluoride compound is dispersed on the surface of the aluminum alloy containing magnesium, a method for spraying the solution on the surface of the aluminum alloy containing magnesium, a method for dipping the aluminum alloy containing magnesium in the solution, and the like are used.

In the process of heating in the oxygen atmosphere the aluminum alloy containing magnesium on which the solution is applied, at first, the aluminum alloy containing magnesium on which the solution is applied is subjected to dry at a temperature equal to or higher than the room temperature and equal to or lower than 100° C. for equal to or more than 0.5 hours and equal to or less than 2 hours.

After that, the aluminum alloy containing magnesium is heated in the oxygen atmosphere (for example, in the air) at a temperature equal to or higher than 350° C. and equal to or lower than 500° C. for equal to or more than 8 hours and equal to or less than 24 hours. Because of the heating, magnesium contained in the alloy is dispersed on the surface of the alloy and is selectively reacted with fluorine contained in the carbon fluoride compound applied over the surface of the alloy to form the fluoride passivation film on the surface of the aluminum alloy containing magnesium.

The reason that the temperature heating the aluminum alloy containing magnesium on which the solution is applied in the oxygen atmosphere is equal to or higher than 350° C. and equal to or lower than 500° C. is because when the heating temperature is less than 350° C., the residue of unreacted solution components or carbon after the reaction remains instead of being oxidized and separated, and when the heating temperature is more than 500° C., the temperature exceeds a softening temperature of the alloy material.

In addition, for the surface treatment method for an aluminum alloy of the invention, since the treatment is performed in the oxygen atmosphere, it is necessary to set up the temperature for forming the fluoride passivation film in consideration of different ignition points in accordance with the kinds of the aluminum alloy containing magnesium.

Therefore, according to the surface treatment method for the aluminum alloy of the invention, the fluoride passivation film formed on the surface of the aluminum alloy containing magnesium is made of a metal compound containing magnesium and fluorine.

According to the surface treatment method for the aluminum alloy of the invention, since the fluoride passivation film is formed on the surface of the aluminum alloy containing magnesium in the oxygen atmosphere, it is possible to form the fluoride passivation film on the surface of the aluminum alloy containing magnesium without using a fluorine-based gas which has been used for a general method for forming a fluoride film.

In addition, according to the surface treatment method for the aluminum alloy of the invention, since a solution, in which a carbon fluoride compound is dispersed, is applied over the surface of the aluminum alloy containing magnesium and then the alloy is heated in the oxygen atmosphere, it is known that magnesium contained in the alloy is dispersed intensively on the surface of the alloy. The magnesium is selectively reacted with fluorine and is reacted in the oxygen atmosphere to oxidize and separate carbon in the carbon fluoride compound, therefore no carbon remains in the fluoride passivation film. Accordingly, the obtained fluoride passivation film includes a metal compound containing magnesium and fluorine, thereby forming a film having a corrosion resistance and effective for preventing scattering of magnesium.

"A surface treatment method for a magnesium alloy"

A surface treatment method for a magnesium alloy of the invention is the method for forming a fluoride passivation film on a surface of the magnesium alloy in the oxygen atmosphere.

The surface treatment method for the magnesium alloy of the invention includes the steps of preparing a solution in which a carbon fluoride compound is dispersed (a process of preparing a solution), applying the solution in which a carbon fluoride compound is dispersed on the surface of the magnesium alloy (a process of applying the solution), heating the magnesium alloy in the oxygen atmosphere (a process of heating the alloy), and forming a fluoride passivation film on the surface of the magnesium alloy.

For the surface treatment method for the magnesium alloy of the invention, examples of the magnesium alloy, which is a target to be subjected to a surface treatment, include AZ-31 alloy and the like.

For the process of preparing the solution in which the carbon fluoride compound is dispersed, the process same as the process of the method used for the surface treatment method for the aluminum alloy is applied.

For the carbon fluoride compound, the compound same as the one used for the surface treatment method for the aluminum alloy is used.

For the solvents dispersing the carbon fluoride compound, the solvent same as the one used for the surface treatment method for the aluminum alloy is used.

For the process of applying the solution in which a carbon fluoride compound is dispersed, the process same as the process of the method used for the surface treatment method for the aluminum alloy is applied.

For the process of heating in the oxygen atmosphere the magnesium alloy on which the solution is applied, the process same as the process of the method used for the surface treatment method for the aluminum alloy is applied.

By heating the magnesium alloy, magnesium contained in the alloy is selectively reacted with fluorine contained in the carbon fluoride compound applied over the surface of the alloy, thereby forming the fluoride passivation film on the surface of the aluminum alloy containing magnesium.

In addition, for the surface treatment method for the magnesium alloy of the invention, since the treatment is performed in the oxygen atmosphere, it is necessary to set up the temperature for forming the fluoride passivation film in consideration of different ignition points in accordance with the kinds of the magnesium alloy.

Therefore, according to the surface treatment method for the magnesium alloy of the invention, the fluoride passivation film formed on the surface of the magnesium alloy is made of a metal compound containing magnesium and fluorine.

According to the surface treatment method for the magnesium alloy of the invention, since the fluoride passivation film is formed on the surface of the magnesium alloy in the oxygen atmosphere, it is possible to form the fluoride passivation film on the surface of the magnesium alloy without using a fluorine-based gas which has been used for a general method for forming a fluoride film.

In addition, according to the surface treatment method for the magnesium alloy of the invention, since a solution, in which a carbon fluoride compound is dispersed, is applied over the surface of the magnesium alloy and then the alloy is heated in the oxygen atmosphere, it is known that magnesium contained in the alloy is dispersed intensively on the surface of the alloy. The magnesium is selectively reacted with fluorine and is reacted in the oxygen atmosphere to oxidize and separate carbon in the carbon fluoride compound, therefore no carbon remains in the fluoride passivation film.

Accordingly, the obtained fluoride passivation film includes a metal compound containing magnesium and fluorine, thereby forming a film having corrosion resistance and effective for preventing scattering of magnesium.

EXAMPLES

The present invention will be more specifically described below with reference to examples, but the invention is not limited thereto.

Example 1

A solution, in which polytetrafluoroethylene (manufactured by Mitsui Dupont Fluoro Chemical Co., Ltd.) was dispersed, was sprayed over a surface of an alloy (A5052 alloy) containing magnesium to be applied thereon. After that, the alloy was heated in the air at 450° C. for 24 hours, thereby performing the surface treatment.

In addition, it is permissible to apply commercially available polytetrafluoroethylene spray (product name: Tef series, manufactured by O-tech) over the alloy and then perform heat treatment in the air.

A cross-section in the vicinity of the surface of an alloy containing magnesium after the surface treatment was observed by a scanning electron microscope (SEM). It was confirmed that a dense layer having a thickness of around 0.2 μm was formed on the surface of the alloy.

The scanning electron microscope image was shown in FIG. 1.

The surface layer in FIG. 1 was the dense layer having the thickness of around 0.2 μm.

Example 2

A specular cross-section surface was shaped on the vicinity of the surface of the alloy containing magnesium, on which the same surface treatment as Example 1 was performed, by using an ultrafine microtome applying a diamond blade.

After that, an elemental analysis of the cross-section surface was performed by an electron probe micro-analyzer (EPMA). Conditions for analyzing the element by using the EPMA included an analyzing width of line of the element, mainly magnesium (Mg), fluorine (F), aluminum (Al), and oxygen (O), set to 15 μm.

Figure 2:
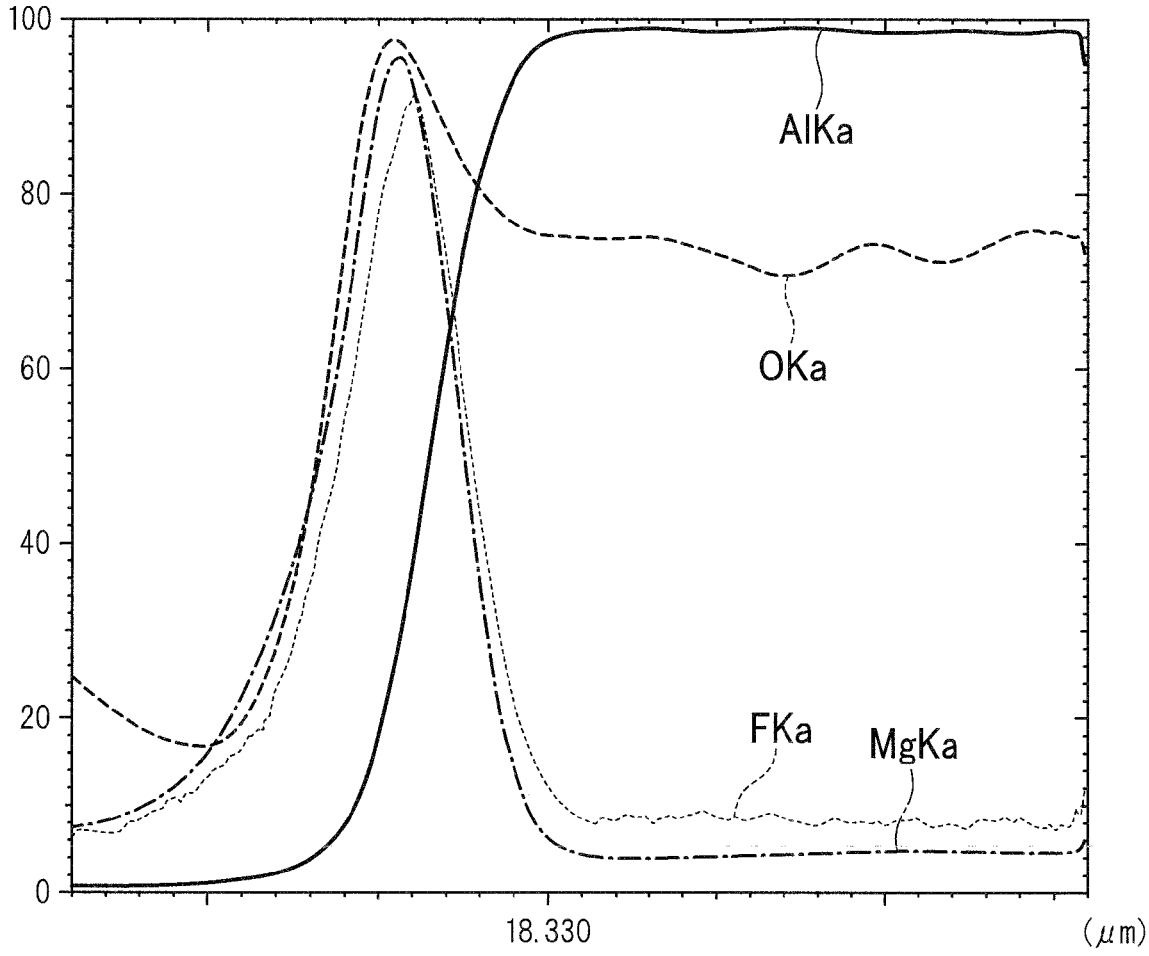
FIG. 2 is a graph showing a result of an elemental analysis of a cross-section in the vicinity of the surface of an alloy containing magnesium prepared by Example 2, on which a fluoride passivation film is provided, performed by an electron probe micro-analyzer.

The result was shown in FIG. 2.

According to FIG. 2, it was confirmed that a large amount of magnesium and fluorine existed on the surface of the alloy containing magnesium, on which the surface treatment was performed, because precipitous peaks of magnesium and fluorine were detected. In addition, since a peak of oxygen was detected from a base material part of the surface layer, that is, the alloy part containing magnesium, it was confirmed that the alloy contains oxygen. In the base material, that is, in the layer of the alloy containing magnesium, a precipitous peak of aluminum was detected and peaks of magnesium and fluorine were dramatically reduced so that only a very small amount of magnesium and fluorine were detected therein. Therefore it was confirmed that the layer of the alloy containing magnesium was constituted mainly of aluminum. As a result, it was confirmed that the surface layer of the alloy containing magnesium was made of a fluoride passivation film.

Besides, a peak intensity of magnesium in the layer of the alloy containing magnesium was less than 5% by weight which is the amount of added magnesium to the alloy.

Example 3

An observation and an elemental analysis of a surface layer formed on a surface of a magnesium alloy was performed in the same way as in Examples 1 and 2, except that A6061 alloy of the magnesium alloy was used instead of using A5052 alloy and the carbon fluoride compound other than polytetrafluoroethylene was used for the surface treatment for the surface of the A6061 alloy.

As a result, it was also confirmed that the surface layer of the magnesium alloy was made of a fluoride passivation film.

Example 4

The alloy containing magnesium, on which the fluoride passivation film prepared in Example 1 is attached, is intensively and repeatedly heated in a vacuum container made of quartz up to the temperature of 550° C.

However, inside wall of the vacuum container, turbidity due to scattering of magnesium was not observed.

Moreover, an analysis of a component of a gas emitted by heating the alloy containing magnesium, on which the fluoride passivation film is attached, was performed by a measuring method for a temperature-programmed desorption spectrum of emitting gas.

Figure 3:
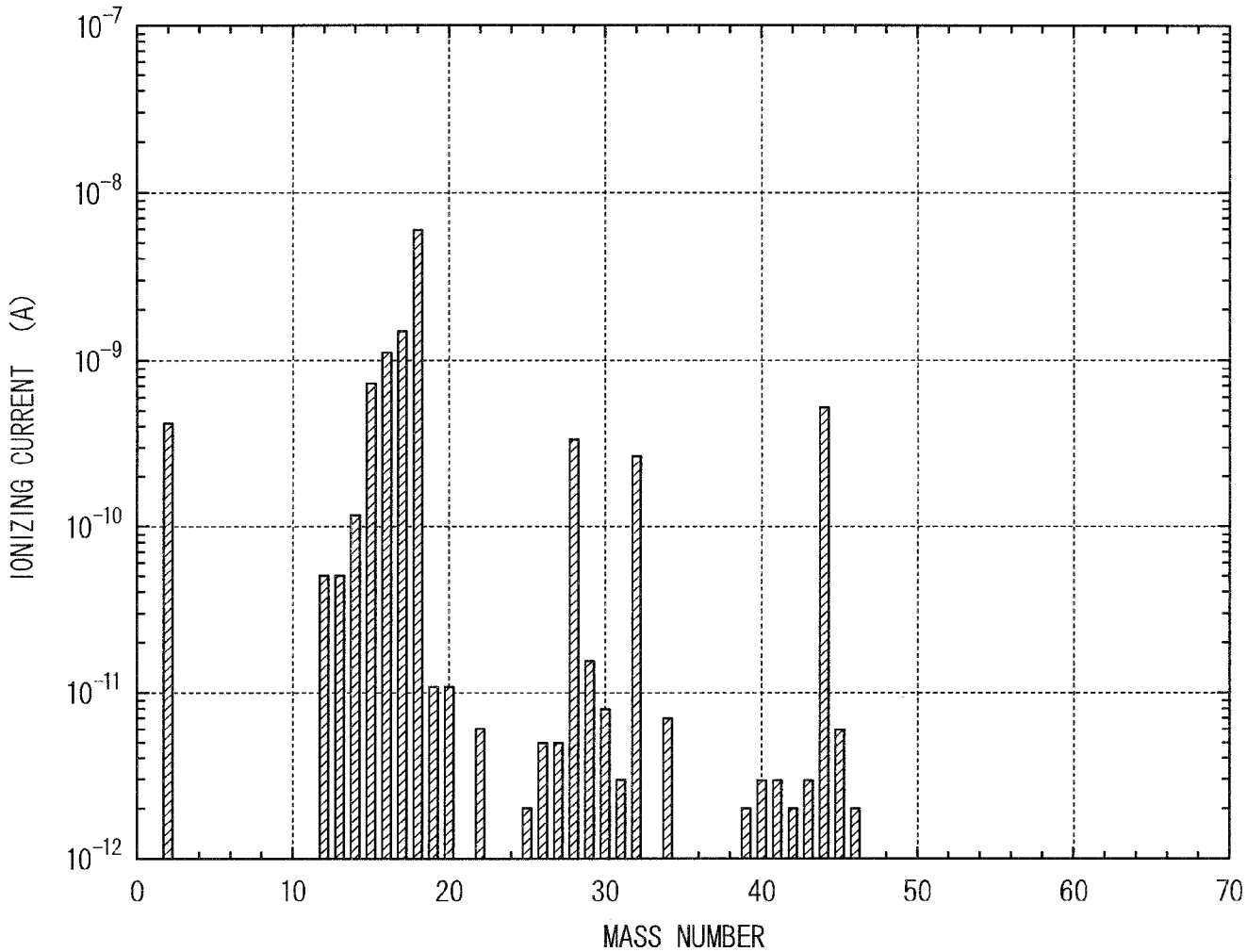
FIG. 3 is a graph showing a result of an analysis of a component of a gas emitted by heating an alloy containing magnesium, on which a fluoride passivation film is provided, performed according to a measurement technique by a heating desorption gas emission spectrum in Example 4.

The result was shown in FIG. 3.

According to the result of FIG. 3, an ejected substance was mainly water, and unreacted components of tetrafluoroethylene or components of emitted fluorine-based gases were not detected. As a result, it was believed that the scattering of magnesium contained in the alloy containing magnesium was prevented even though the alloy containing magnesium was heated because of the existence of the fluoride passivation film. Accordingly, the fluoride passivation film is considered to be effective as a surface layer for a vacuum application.

INDUSTRIAL APPLICABILITY

A surface treatment method for an aluminum alloy containing magnesium and a surface treatment method for a magnesium alloy, of the present invention can be applied to a surface treatment of an aluminum alloy or a magnesium alloy which can be used as a member of inside a vacuum container constituting a vacuum apparatus other than an apparatus for plasma CVD.

What is claimed is:

1. A surface treatment method for an aluminum alloy comprising:

forming a fluoride passivation film on a surface of the aluminum alloy containing magnesium by applying a solution which is obtained by dispersing a carbon fluoride compound in alkyl ether, ethyl acetate, or butyl acetate over the surface of the aluminum alloy containing magnesium and then heating in an oxygen atmosphere, wherein a content rate of the carbon fluoride compound is equal to or more than 30% by weight and equal to or less than 50% by weight.

2. The surface treatment method for an aluminum alloy according to claim 1, heating in the oxygen atmosphere comprises drying the aluminum alloy containing magnesium, and then heating the aluminum alloy containing magnesium.

3. The surface treatment method for an aluminum alloy according to claim 1, wherein the fluoride passivation film is composed of a metal compound containing magnesium and fluorine.

4. The surface treatment method for the aluminum alloy according to claim 2, wherein the aluminum alloy containing magnesium is dried at a temperature equal to or higher than a room temperature and equal to or lower than 100° C. for equal to or more than 0.5 hours and equal to or less than 2 hours.

5. The surface treatment method for the aluminum alloy according to claim 2, wherein the aluminum alloy containing magnesium is heated in the oxygen atmosphere at a temperature equal to or higher than 350° C. and equal to or lower than 500° C. for equal to or more than 8 hours and equal to or less than 24 hours.

6. A surface treatment method for a magnesium alloy comprising:

forming a fluoride passivation film on a surface of the magnesium alloy by applying a solution which is obtained by dispersing a carbon fluoride compound in alkyl ether, ethyl acetate, or butyl acetate over the surface of the magnesium alloy and then heating in an oxygen atmosphere, wherein a content rate of the carbon fluoride compound is equal to or more than 30% by weight and equal to or less than 50% by weight.

7. The surface treatment method for a magnesium alloy according to claim 6, heating in the oxygen atmosphere comprises drying the magnesium alloy, and then heating the magnesium alloy.

8. The surface treatment method for the magnesium alloy according to claim 6, wherein the fluoride passivation film is composed of a metal compound containing magnesium and fluorine.

9. The surface treatment method for the magnesium alloy according to claim 7, wherein the magnesium alloy is dried at a temperature equal to or higher than ache room temperature and equal to or lower than 100° C. for equal to or more than 0.5 hours and equal to or less than 2 hours.

10. The surface treatment method for the magnesium alloy according to claim 7, wherein the magnesium alloy is heated in the oxygen atmosphere at a temperature equal to or higher than 350° C. and equal to or lower than 500° C. or equal to or more than 8 hours and equal to or less than 24 hours.

* * * * *